US009792894B2

(12) United States Patent
Tachibana et al.

(10) Patent No.: US 9,792,894 B2
(45) Date of Patent: Oct. 17, 2017

(54) SPEECH SYNTHESIS DICTIONARY CREATING DEVICE AND METHOD

(71) Applicant: KABUSHIKI KAISHA TOSHIBA, Tokyo (JP)

(72) Inventors: Kentaro Tachibana, Kanagawa (JP); Masahiro Morita, Kanagawa (JP); Takehiko Kagoshima, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 28 days.

(21) Appl. No.: 14/970,718

(22) Filed: Dec. 16, 2015

(65) Prior Publication Data

US 2016/0104475 A1 Apr. 14, 2016

Related U.S. Application Data

(63) Continuation of application No. PCT/JP2013/066949, filed on Jun. 20, 2013.

(51) Int. Cl.
*G10L 13/00* (2006.01)
*G10L 13/04* (2013.01)
*G10L 13/06* (2013.01)

(52) U.S. Cl.
CPC ..... *G10L 13/04* (2013.01); *G10L 13/06* (2013.01)

(58) Field of Classification Search
CPC ..... G10L 13/04; G10L 13/08; G10L 17/005
USPC ..... 704/260
See application file for complete search history.

(56) References Cited

U.S. PATENT DOCUMENTS 7,355,623 B2 * 4/2008 Cutler ..... H04N 7/147 348/14.08
8,005,677 B2 * 8/2011 Cutaia ..... G10L 13/033 704/260
8,719,019 B2 * 5/2014 Do ..... G10L 17/02 434/185
2009/0119096 A1 * 5/2009 Gerl ..... G10L 21/0208 704/207

(Continued)

FOREIGN PATENT DOCUMENTS

JP S57-13493 A 1/1982
JP 62-23097 A 1/1987

(Continued)

OTHER PUBLICATIONS

Written Opinion of the International Searching Authority dated Jul. 23, 2013 as issued in corresponding application No. PCT/JP2013/066949 and its English translation thereof.

*Primary Examiner* — Daniel Abebe
(74) *Attorney, Agent, or Firm* — Foley & Lardner LLP

(57) ABSTRACT

According to an embodiment, a speech synthesis dictionary creating device includes a first speech input unit, a second speech input unit, a determining unit, and a creating unit. The first speech input unit receives input of first speech data. The second speech input unit receives input of second speech data which is considered to be appropriate speech data. The determining unit determines whether or not a speaker of the first speech data is the same as a speaker of the second speech data. When the determining unit determines that the speaker of the first speech data is the same as the speaker of the second speech data, the creating unit creates a speech synthesis dictionary using the first speech data and using a text corresponding to the first speech data.

9 Claims, 4 Drawing Sheets

(56) References Cited

U.S. PATENT DOCUMENTS

2013/0144603 A1* 6/2013 Lord ..... H04L 12/1831
704/9

FOREIGN PATENT DOCUMENTS

JP S62-23097 A 1/1987
JP 2010-117528 A 5/2010

* cited by examiner

SPEECH SYNTHESIS DICTIONARY CREATING DEVICE AND METHOD

CROSS-REFERENCE TO RELATED APPLICATIONS

This application is a continuation of PCT international application Ser. No. PCT/JP2013/066949 filed on Jun. 20, 2013 which designates the United States; the entire contents of which are incorporated herein by reference.

FIELD

Embodiments described herein relate generally to a speech synthesis dictionary creating dictionary and a speech synthesis dictionary creating method.

BACKGROUND

In recent years, with the enhancement in the quality of the speech synthesis technology, the range of use of the speech synthesis has drastically expanded, such as in car navigation systems, in voice mail reading applications of cellular phones, and in voice assistant applications. Moreover, a service for creating a speech synthesis dictionary from the speeches of general users is also being provided. In that service, if only recorded speeches are available, a speech synthesis dictionary can be created from the speeches of whosoever.

However, if speeches are obtained in a fraudulent manner from the TV or the Internet, then it becomes possible to create a speech synthesis dictionary by impersonating someone else, and the speech synthesis dictionary is at risk of being misused.

DETAILED DESCRIPTION

According to an embodiment, a speech synthesis dictionary creating device includes a first speech input unit, a second speech input unit, a determining unit, and a creating unit. The first speech input unit receives input of first speech data. The second speech input unit receives input of second speech data which is considered to be appropriate speech data. The determining unit determines whether or not a speaker of the first speech data is the same as a speaker of the second speech data. When the determining unit determines that the speaker of the first speech data is the same as the speaker of the second speech data, the creating unit creates a speech synthesis dictionary using the first speech data and using a text corresponding to the first speech data. According to an embodiment, a navigation device installed in a vehicle includes an obtainer, a controller, and a reproducer. The obtainer obtains at least one of vehicle information related to the vehicle and driver information related to a driver of the vehicle. The controller controls, based on at least one of the vehicle information and the driver information, localization direction of a playback sound which is to be reproduced for the driver. The reproducer reproduces the playback sound using a three dimensional sound based on control of the localization direction.

First Embodiment

Figure 1:
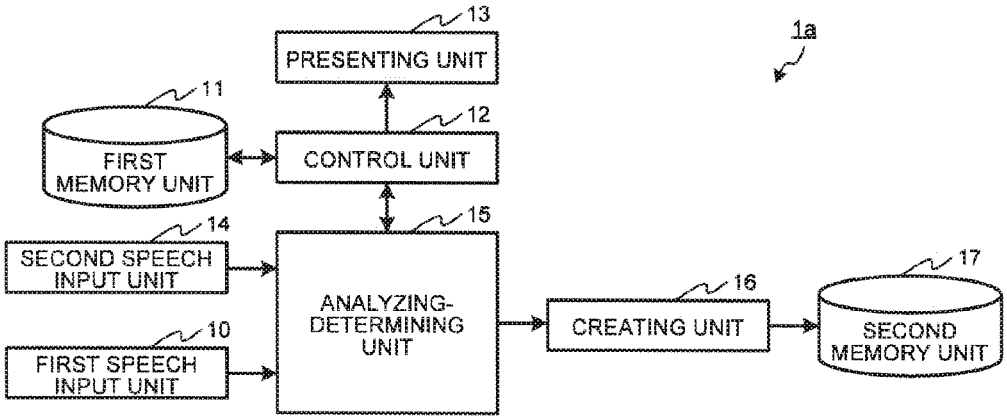
FIG. 1 is a configuration diagram illustrating a configuration of a speech synthesis dictionary creating device according to a first embodiment.

A speech synthesis dictionary creating device according to a first embodiment is explained below with reference to the accompanying drawings. FIG. 1 is a configuration diagram illustrating a configuration of a speech synthesis dictionary creating device 1*a* according to the first embodiment. Herein, for example, the speech synthesis dictionary creating device 1*a* is implemented using a general-purpose computer. That is, for example, the speech synthesis dictionary creating device 1*a* has the functions of a computer including a CPU, a memory device, an input-output device, and a communication interface.

As illustrated in FIG. 1, the speech synthesis dictionary creating device 1*a* includes a first speech input unit 10, a first memory unit 11, a control unit 12, a presenting unit 13, a second speech input unit 14, an analyzing-determining unit 15, a creating unit 16, and a second memory unit 17. Herein, the first speech input unit 10, the control unit 12, the presenting unit 13, the second speech input unit 14, and the analyzing-determining unit 15 either may be configured using hardware or may be configured using software executed by the CPU. The first memory unit 11 and the second memory unit 17 are configured using, for example, an HDD (Hard Disk Drive) or a memory. Thus, the speech synthesis dictionary creating device 1*a* may be so configured that the functions thereof are implemented by executing a speech synthesis dictionary creating program.

The first speech input unit 10 receives, for example, speech data (first speech data) of an arbitrary user via, for example, a communication interface (not illustrated); and inputs the speech data to the analyzing-determining unit 15. Meanwhile, the first speech input unit 10 may include hardware such as a communication interface and a microphone.

The first memory unit 11 stores therein a plurality of texts (or recorded texts) and outputs any one of the stored texts in response to the control of the control unit 12. The control unit 12 controls the constituent units of the speech synthesis dictionary creating device 1*a*. Moreover, the control unit 12 selects any one of the texts stored in the first memory unit 11, reads the selected text from the first memory unit 11, and outputs the read text to the presenting unit 13.

The presenting unit 13 receives any one of the texts, which are stored in the first memory unit 11, via the control unit 12 and presents the received text to the user. Herein, the presenting unit 13 presents the texts, which are stored in the first memory unit 11, in a random manner. Moreover, the presenting unit 13 presents a text only for a predetermined period of time (for example, for about few seconds to one minute). Meanwhile, for example, the presenting unit 13 may be a display device, a speaker, or a communication interface. That is, in order to enable the user to recognize and utter the selected text, the presenting unit 13 performs text presentation either by displaying a text or by performing speech output of a recorded text.

When an arbitrary user, for example, reads aloud the text presented by the presenting unit 13, the second speech input unit 14 receives speech data thereof as appropriate speech data (second speech data), and inputs it to the analyzing-determining unit 15. Herein, the second speech input unit 14 may receive the second speech data via, for example, a communication interface (not illustrated). Meanwhile, the second speech input unit 14 may include hardware, such as a communication interface and a microphone, shared with the first speech input unit 10 or may include shared software.

Upon receiving the first speech data via the first speech input unit 10, the analyzing-determining unit 15 causes the control unit 12 to start operations so that the presenting unit 13 presents a text. Moreover, upon receiving the second speech data via the second speech input unit 14, the analyzing-determining unit 15 determines whether or not the speaker of the first speech data is the same as the speaker of the second speech data by comparing the feature quantity of the first speech data with the feature quantity of the second speech data.

For example, the analyzing-determining unit 15 performs speech recognition on the first speech data and the second speech data, and generates texts respectively corresponding to the first speech data and the second speech data. Moreover, the analyzing-determining unit 15 may perform a speech quality check on the second speech data to determine whether or not the signal-to-noise ratio (SNR) and the amplitude value are equal to or greater than predetermined threshold values. Meanwhile, the analyzing-determining unit 15 compares the feature quantities based on at least one of the following properties of the first speech data and the second speech data: the amplitude values, the average or the dispersion of fundamental frequencies ($F_0$), the correlation of spectral envelope extraction results, the word accuracy rates in speech recognition, and the word recognition rates. Herein, examples of the spectral envelope extraction method include the linear prediction coefficient (LPC), the mel frequency cepstrum coefficient, the line spectrum pair (LSP), the mel LPC, and the mel LSP.

Then, the analyzing-determining unit 15 compares the feature quantity of the first speech data with the feature-quantity of the second speech data. If the difference between the feature quantity of the first speech data and the feature quantity of the second speech data is equal to or smaller than a predetermined threshold value or if the correlation between the feature quantity of the first speech data and the feature quantity of the second speech data is equal to or greater than a predetermined threshold value, then the analyzing-determining unit 15 determines that the speaker of the first speech data is the same as the speaker of the second speech data. Herein, the threshold values used in determination by the analyzing-determining unit 15 are assumed to be set by learning in advance the average and the dispersion of feature quantities of the same person or by learning in advance the speech recognition result, from a large volume of data.

When it is determined that the speaker of the first speech data is the same as the speaker of the second speech data, the analyzing-determining unit 15 determines that the speech is appropriate. Then, the analyzing-determining unit 15 outputs the first speech data (and the second speech data), the speaker of which is determined to be the same as the speaker of the second speech data, as appropriate speech data to the creating unit 16. Meanwhile, the analyzing-determining unit 15 may be divided into an analyzing unit that analyzes the first speech data and the second speech data, and a determining unit that performs determination.

The creating unit 16 implements a speech recognition technology and, from the first speech data received via the analyzing-determining unit 15, creates a text of the uttered contents. Then, the creating unit 16 creates a speech synthesis dictionary using the created text and the first speech data, and outputs the speech synthesis dictionary to the second memory unit 17. Thus, the second memory unit 17 stores therein the speech synthesis dictionary received from the creating unit 16.

Modification Example of First Embodiment

Figure 2:
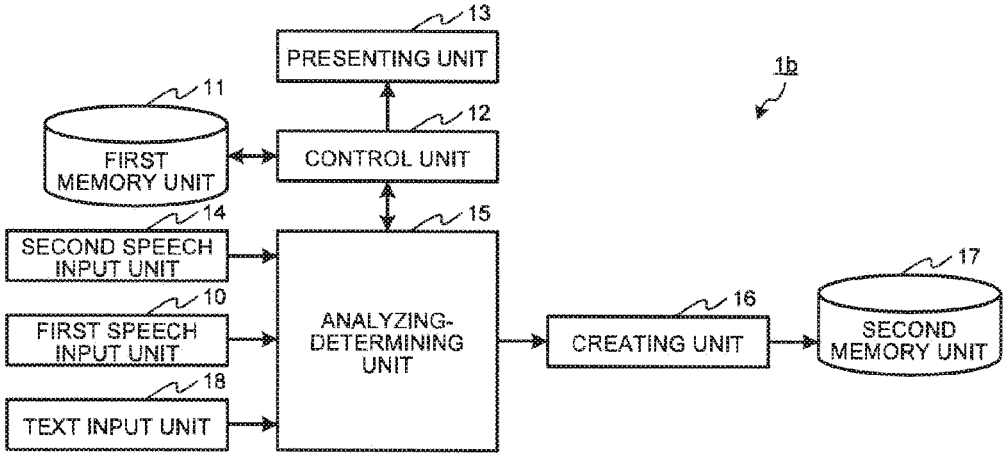
FIG. 2 is a configuration diagram illustrating a configuration of a modification example of the speech synthesis dictionary creating device according to the first embodiment.

FIG. 2 is a configuration diagram illustrating a configuration of a modification example of the speech synthesis dictionary creating device 1*a* illustrated in FIG. 1 according to the first embodiment (a configuration example of a speech synthesis dictionary creating device 1*b*). As illustrated in FIG. 2, the speech synthesis dictionary creating device 1*b* includes the first speech input unit 10, the first memory unit 11, the control unit 12, the presenting unit 13, the second speech input unit 14, the analyzing-determining unit 15, the creating unit 16, the second memory unit 17, and a text input unit 18. In the speech synthesis dictionary creating device 1*b*, the constituent elements that are practically identical to the constituent elements of the speech synthesis dictionary creating device 1*a* are referred to by the same reference numerals.

The text input unit 18 receives a text corresponding to the first speech data via, for example, a communication interface (not illustrated), and inputs the text to the analyzing-determining unit 15. Herein, the text input unit 18 may be configured using hardware such as an input device capable of receiving text input, or can be configured using software.

The analyzing-determining unit 15 treats speech data obtained by uttering, by a user, of the text input to the text input unit 18 as the first speech data, and determines whether or not the speaker of the first speech data is the same as the speaker of the second speech data. Then, the creating unit 16 creates a speech synthesis dictionary using the speech that is determined to be appropriate by the analyzing-determining unit 15 and using the text input to the text input unit 18. Thus, in the speech synthesis dictionary creating device 1*b*, since the text input unit 18 is included, there is no need to create a text by performing speech recognition. That enables achieving reduction in the processing load.

Figure 3:
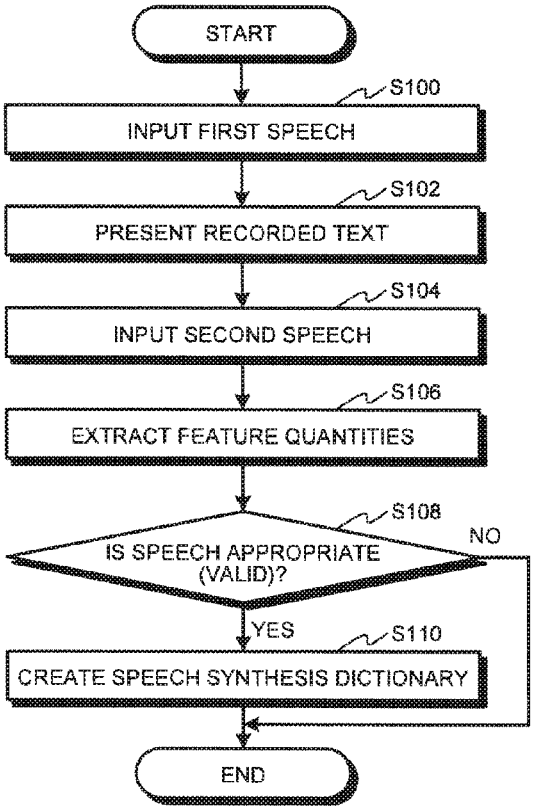
FIG. 3 is a flowchart for explaining the operations performed in the speech synthesis dictionary creating device according to the first embodiment for creating a speech synthesis dictionary.

Given below is the explanation of the operations performed in the speech synthesis dictionary creating device 1*a* according to the first embodiment (or in the speech synthesis dictionary creating device 1*b*) for creating a speech synthesis dictionary. FIG. 3 is a flowchart for explaining the operations performed in the speech synthesis dictionary creating device 1*a* according to the first embodiment (or in the speech synthesis dictionary creating device 1*b*) for creating a speech synthesis dictionary.

As illustrated in FIG. 3, at Step 100 (S100), the first speech input unit 10 receives input of first speech data via, for example, a communication interface (not illustrated), and inputs the first speech data to the analyzing-determining unit 15 (first speech input).

At Step 102 (S102), the presenting unit 13 presents a recorded text (or a text) to the user.

At Step 104 (S104), the second speech input unit 14 receives, as appropriate speech data (the second speech data), speech data which is obtained when the text presented by the presenting unit 13 is, for example, read aloud by the user; and inputs the second speech data to the analyzing-determining unit 15.

At Step 106 (S106), the analyzing-determining unit 15 extracts the feature quantity of the first speech data and the feature quantity of the second speech data.

At Step 108 (S108), the analyzing-determining unit 15 compares the feature quantity of the first speech data with the feature quantity of the second speech data, to thereby determine whether or not the speaker of the first speech data is the same as the speaker of the second speech data. In the speech synthesis dictionary creating device 1*a* (or the speech synthesis dictionary creating device 1*b*), if the analyzing-determining unit 15 determines that the speaker of the first speech data is the same as the speaker of the second speech data (Yes at S108); then the system control proceeds to S110 on the premise that the speech is appropriate. If the analyzing-determining unit 15 determines that the speaker of the first speech data is not the same as the speaker of the second speech data (No at S108); then the speech synthesis dictionary creating device 1*a* (or the speech synthesis dictionary creating device 1*b*) marks the end of the operations.

At Step 110 (S110), the creating unit 16 creates a speech synthesis dictionary using the first speech data (and the second speech data), which is determined to be appropriate by the analyzing-determining unit 15, and using the text corresponding to the first speech data (and the second speech data); and outputs the speech synthesis dictionary to the second memory unit 17.

Figure 4:
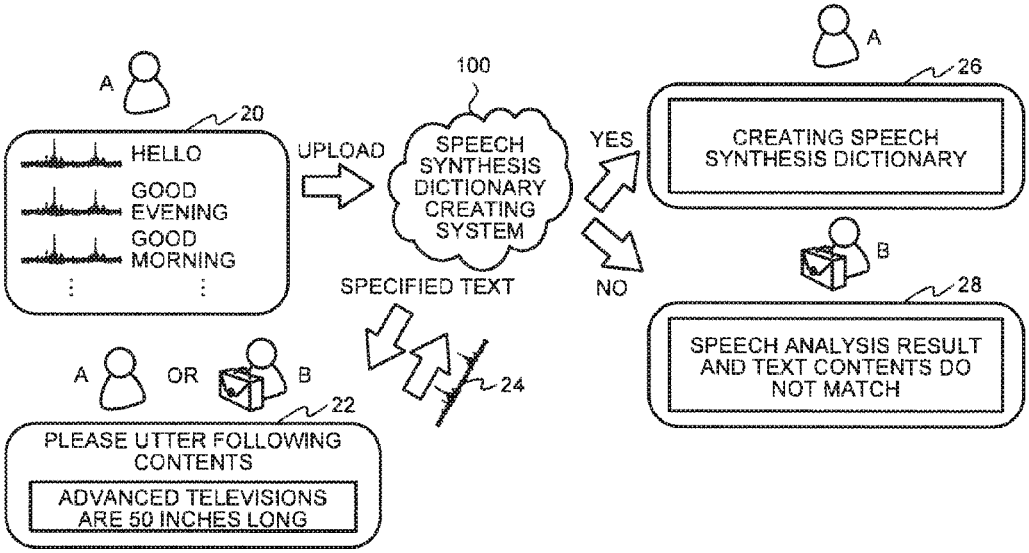
FIG. 4 is a diagram that schematically illustrates an example of the operations performed in a speech synthesis dictionary creating system including the speech synthesis dictionary creating device according to the first embodiment.

FIG. 4 is a diagram that schematically illustrates an example of the operations performed in a speech synthesis dictionary creating system 100 including the speech synthesis dictionary creating device 1*a*. The speech synthesis dictionary creating system 100 includes the speech synthesis dictionary creating device 1*a*, and performs input and output of data (speech data and texts) via a network (not illustrated). That is, the speech synthesis dictionary creating system 100 is a system for creating a speech synthesis dictionary with the use of the speeches uploaded by the users of the system and providing the speech synthesis dictionary.

With reference to FIG. 4, first speech data 20 represents the speech data generated by a person A by uttering an arbitrary number of texts having arbitrary contents. The first speech data 20 is received by the first speech input unit 10.

A presentation example 22 prompts the user to utter a text "advanced televisions are a 50-inch in size" that is presented by the speech synthesis dictionary creating device 1*a*. Second speech data 24 represents the speech data obtained when the text presented by the speech synthesis dictionary creating device 1*a* is read aloud by the user. The second speech data 24 is input to the second speech input unit 14. In the speeches obtained via the TV or the Internet, it is difficult to utter the texts that are randomly presented by the speech synthesis dictionary creating device 1*a*. The second speech input unit 14 treats the received speech data as appropriate speech data and outputs it to the analyzing-determining unit 15.

The analyzing-determining unit 15 compares the feature quantity of the first speech data 20 with the feature quantity of the second speech data 24 to thereby determine whether or not the speaker of the first speech data 20 is the same as the speaker of the second speech data 24.

If the speaker of the first speech data 20 is the same as the speaker of the second speech data 24, then the speech synthesis dictionary creating system 100 creates a speech synthesis dictionary and, for example, displays to the user a display 26 as a notification about creating the speech synthesis dictionary. On the other hand, if the speaker of the first speech data 20 is not the same as the speaker of the second speech data 24, then the speech synthesis dictionary creating system 100 rejects the first speech data 20 and, for example, displays to the user a display 28 as a notification about not creating the speech synthesis dictionary.

Second Embodiment

Figure 5:
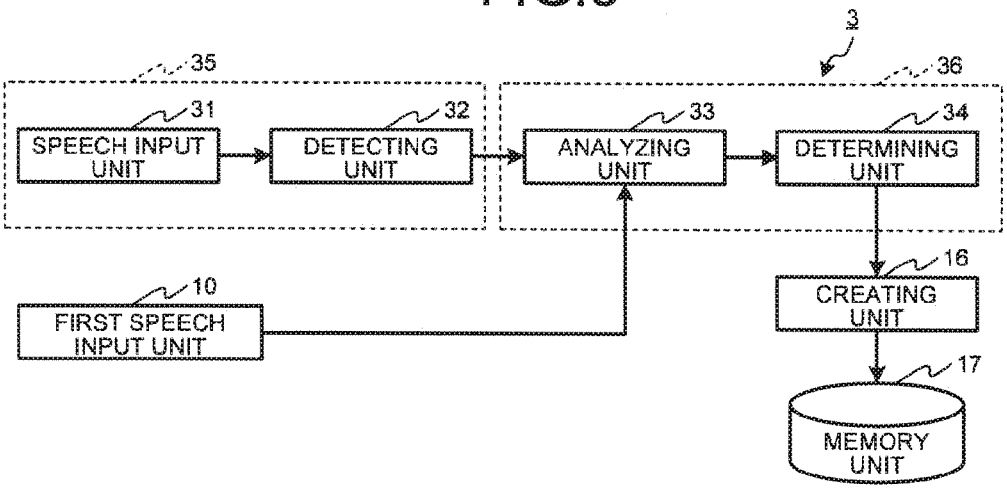
FIG. 5 is a configuration diagram illustrating a configuration of a speech synthesis dictionary creating device according to a second embodiment.

Given below is the explanation of a speech synthesis creating device according to a second embodiment. FIG. 5 is a configuration diagram illustrating a configuration of a speech synthesis dictionary creating device 3 according to the second embodiment. Herein, for example, the speech synthesis dictionary creating device 3 is implemented using a general-purpose computer. That is, for example, the speech synthesis dictionary creating device 3 has the functions of a computer including a CPU, a memory device, an input-output device, and a communication interface.

As illustrated in FIG. 5, the speech synthesis dictionary creating device 3 includes the first speech input unit 10, a speech input unit 31, a detecting unit 32, an analyzing unit 33, a determining unit 34, the creating unit 16, and the second memory unit 17. In the speech synthesis dictionary creating device 3 illustrated in FIG. 3, the constituent elements that are practically identical to the constituent elements of the speech synthesis dictionary creating device 1*a* illustrated in FIG. 1 are referred to by the same reference numerals.

The speech input unit 31, the detecting unit 32, the analyzing unit 33, and the determining unit 34 either may be configured using hardware or may be configured using software executed by the CPU. Thus, the speech synthesis dictionary creating device 3 can be so configured that the functions thereof are implemented by executing a speech synthesis dictionary creating program.

The speech input unit 31 inputs, to the detecting unit 32, speech data recorded by, for example, a speech recording device capable of embedding authentication information and arbitrary speech data such as speech data recorded by other recording devices.

Meanwhile, a speech recording device capable of embedding authentication information embeds authentication information in a successive but random manner in, for example, the entire speech, or specified text contents, or text numbers. Examples of the embedding method include encryption using a public key or a shared key, and digital watermarking. When the authentication information represents encryption, the speech waveforms are encrypted (waveform encryption). Digital watermarking applied to the speech includes an echo diffusion method using successive masking; a spectral diffusion method and a patchwork method in which the amplitude spectrum is manipulated/modulated and bit information is embedded; or a phase modulation method in which bit information is embedded by modulating the phase.

The detecting unit 32 detects authentication information included in the speech data received by the speech input unit 31. Moreover, the detecting unit 32 extracts authentication information from the speech data in which the authentication information is embedded. When waveform encryption is implemented as the embedding method, the detecting unit 32 can be configured to perform decryption using a private key. When the authentication information represents digital watermarking, the detecting unit 32 obtains bit information according to decoding sequences.

When authentication information is detected, the detecting unit 32 considers that the input speech data is the speech data recorded by the specified speech recording device. In this way, the detecting unit 32 sets the speech data, in which authentication information is detected, as the second speech data considered to be appropriate, and outputs the second speech data to the analyzing unit 33.

Meanwhile, for example, the speech input unit 31 and the detecting unit 32 may be integrated as a second speech input unit 35 that detects authentication information included in arbitrary speech data and output speech data, in which authentication information is detected, as the second speech data considered to be appropriate.

The analyzing unit 33 receives the first speech data from the first speech input unit 10, receives the second speech data from the detecting unit 32, analyzes the first speech data and the second speech data, and outputs the analysis result to the determining unit 34.

For example, the analyzing unit 33 performs speech recognition on the first speech data and the second speech data, and generates a text corresponding to the first speech data and a text corresponding to the second speech data. Moreover, the analyzing unit 33 may perform a speech quality check on the second speech data to determine whether or not the signal-to-noise ratio (SNR) and the amplitude value are equal to or greater than predetermined threshold values. Furthermore, the analyzing unit 33 extracts feature quantities based on at least one of the following properties of the first speech data and the second speech data: the amplitude values, the average or the dispersion of fundamental frequencies ($F_0$), the correlation of spectral envelope extraction results, the word accuracy rates in speech recognition, and the word recognition rates. The spectral envelope extraction method can be identical to the method implemented by the analyzing-determining unit 15 (FIG. 2).

The determining unit 34 receives the feature quantities calculated by the analyzing unit 33. Then, the determining unit 34 compares the feature quantity of the first speech data with the feature quantity of the second speech data to thereby determine whether or not the speaker of the first speech data is the same as the speaker of the second speech data. For example, if the difference between the feature quantity of the first speech data and the feature quantity of the second speech data is equal to or smaller than a predetermined threshold value or if the correlation between the feature quantity of the first speech data and the feature quantity of the second speech data is equal to or greater than a predetermined threshold value, then the determining unit 34 determines that the speaker of the first speech data is the same as the speaker of the second speech data. Herein, the threshold values used in determination by the determining unit 34 are assumed to be set by learning in advance the average and the dispersion of feature quantities of the same person or by learning in advance the speech recognition result, from a large volume of data.

If it is determined that the speaker of the first speech data is the same as the speaker of the second speech data, the determining unit 34 determines that the speech is appropriate. Then, the determining unit 34 outputs, to the creating unit 16, the first speech data (and the second speech data), the speaker of which is determined to be the same as the speaker of the second speech data, as appropriate speech data. Meanwhile, the analyzing unit 33 and the determining unit 34 may be configured together as an analyzing-determining unit 36 that functions in an identical manner to the analyzing-determining unit 15 of the speech synthesis dictionary creating device 1*a* (FIG. 1).

Figure 6:
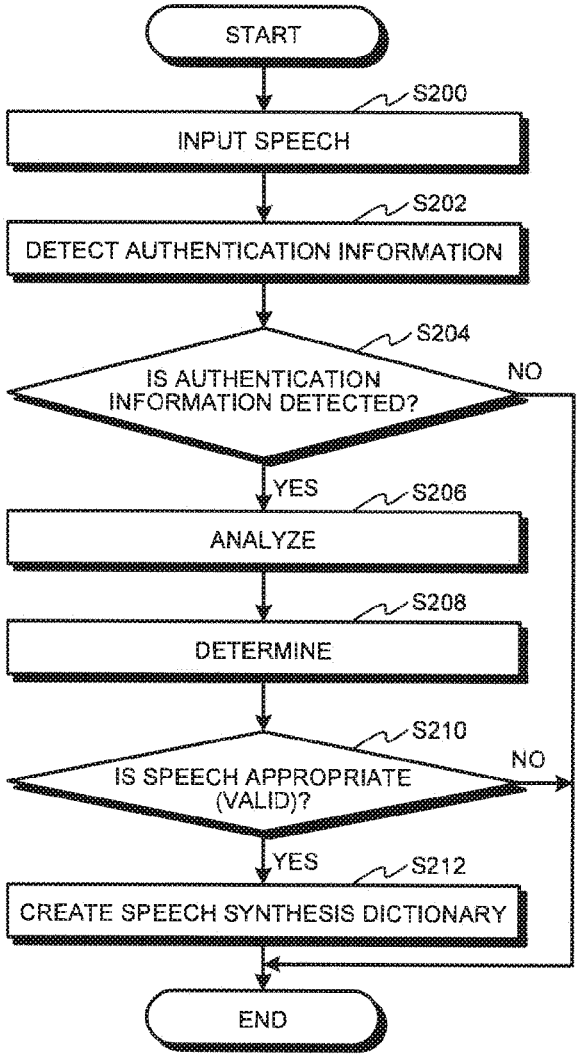
FIG. 6 is a flowchart for explaining the operations performed in the speech synthesis dictionary creating device according to the second embodiment for creating the speech synthesis dictionary.

Given below is the explanation of the operations performed in the speech synthesis dictionary creating device 3 according to the second embodiment for creating the speech synthesis dictionary. FIG. 6 is a flowchart for explaining the operations performed in the speech synthesis dictionary creating device 3 according to the second embodiment for creating the speech synthesis dictionary.

As illustrated in FIG. 6, at Step 200 (S200), the first speech input unit 10 inputs first speech data to the analyzing unit 33, and the speech input unit 31 inputs arbitrary speech data to the detecting unit 32 (speech input).

At Step 202 (S202), the detecting unit 32 detects authentication information.

At Step 204 (S204), for example, the speech synthesis dictionary creating device 3 determines whether or not the detecting unit 32 has detected authentication information from the arbitrary speech data. In the speech synthesis dictionary creating device 3, if the detecting unit 32 has detected authentication information (Yes at S204); then the system control proceeds to S206. On the other hand, in the speech synthesis dictionary creating device 3, if the detecting unit 32 has not detected authentication information (No at S204); then it marks the end of the operations.

At Step 206 (S206), the analyzing unit 33 extracts the feature quantity of the first speech data and the feature quantity of the second speech data (analysis).

At Step 208 (S208), the determining unit 34 compares the feature quantity of the first speech data with the feature quantity of the second speech data to thereby determine whether or not the speaker of the first speech data is the same as the speaker of the second speech data.

At Step 210 (S210), in the speech synthesis dictionary creating device 3, if the determining unit 34 determines at S208 that the speaker of the first speech data is the same as the speaker of the second speech data (Yes at S210), then the system control proceeds to S212 on the premise that the speech is appropriate. On the other hand, in the speech synthesis dictionary creating device 3, if the determining unit 34 determines at S208 that the speaker of the first speech data is not the same as the speaker of the second speech data (No at S210), then it marks the end of the operations on the premise that the speech is not appropriate.

At Step 212 (S212), the creating unit 16 creates a speech synthesis dictionary corresponding to the first speech data (and the second speech data) that is determined to be appropriate by the determining unit 34; and outputs the speech synthesis dictionary to the second memory unit 17.

Figure 7:
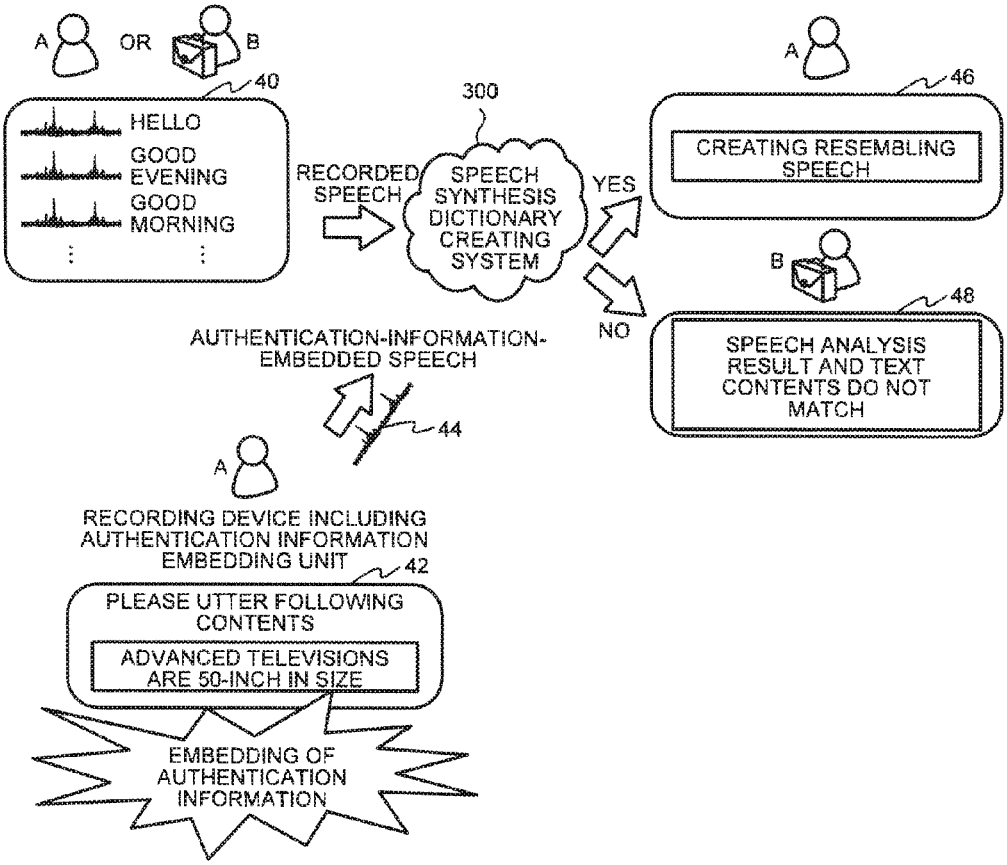
FIG. 7 is a diagram that schematically illustrates an example of the operations performed in a speech synthesis dictionary creating system including the speech synthesis dictionary creating device according to the second embodiment.

FIG. 7 is a diagram that schematically illustrates an example of the operations performed in a speech synthesis dictionary creating system 300 including the speech synthesis dictionary creating device 3. The speech synthesis dictionary creating system 300 includes the speech synthesis dictionary creating device 3, and performs input and output of data (speech data) via a network (not illustrated). That is, the speech synthesis dictionary creating system 300 is a system for creating a speech synthesis dictionary with the use of the speeches uploaded by the users and providing the speech synthesis dictionary.

With reference to FIG. 7, first speech data 40 represents the speech data generated by a person A or a person B by uttering an arbitrary number of texts having arbitrary contents. The first speech data 40 is received by the first speech input unit 10.

For example, the person A reads aloud a text "advanced televisions are 50-inch in size" that is presented by a recording device 42 including an authentication information embedding unit, and performs speech recording. The text uttered by the person A represents authentication-information-embedded speech 44 in which authentication information is embedded. Hence, the authentication-information-embedded speech (the second speech data) is considered to be the speech data recorded by a pre-specified recording device capable of embedding authentication information in speech data. That is, the authentication-information-embedded speech is considered to be appropriate speech data.

The speech synthesis dictionary creating system 300 compares the feature quantity of the first speech data 40 and the feature quantity of the authentication-information-embedded speech (the second speech data) 44 to thereby determine whether or not the speaker of the first speech data 40 is the same as the speaker of the authentication-information-embedded speech (the second speech data) 44.

If the speaker of the first speech data 40 is the same as the speaker of the authentication-information-embedded speech (the second speech data) 44, the speech synthesis dictionary creating system 300 creates a speech synthesis dictionary and, for example, displays to the user a display 46 as a notification about creating the speech synthesis dictionary. On the other hand, if the speaker of the first speech data 40 is not the same as the speaker of the authentication-information-embedded speech (the second speech data) 44, the speech synthesis dictionary creating system 300 rejects the first speech data 40 and, for example, displays to the user a display 48 as a notification about not creating the speech synthesis dictionary.

In this way, in the speech synthesis dictionary creating device according to the embodiments, since it is determined whether or not the speaker of the first speech data is the same as the speaker of the second speech data that is considered to be appropriate speech data, it becomes possible to prevent creation of a speech synthesis dictionary in a fraudulent manner.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A speech synthesis dictionary creating device comprising:

a processing circuitry coupled to a memory, the processing circuitry being configured to:

receive input of first speech data;

select at least one text from texts stored in the memory;

present the selected text for a user to recognize and utter the selected text;

receive input of second speech data which is considered to be speech data obtained by uttering of the presented text; and create a speech synthesis dictionary using the first speech data and using a text corresponding to the first speech data upon determining that a speaker of the first speech data is the same as a speaker of the second speech data.

2. The device according to claim 1, wherein the processing circuitry is configured to perform at least one of randomly presenting any one of the texts stored in the memory and presenting any one of the texts only for a predetermined period of time.

3. The device according to claim 1, wherein the processing circuitry is configured to determine whether the speaker of the first speech data is the same as the speaker of the second speech data by comparing feature quantity of the first speech data with feature quantity of the second speech data.

4. The device according to claim 3, wherein the processing circuitry is configured to compare feature quantities based on at least either word recognition rates, word accuracy rates, amplitudes, fundamental frequencies, and spectral envelops of the first speech data and the second speech data.

5. The device according to claim 4, wherein, when a difference between the feature quantity of the first speech data and the feature quantity of the second speech data is equal to or smaller than a predetermined threshold value or when correlation between the feature quantity of the first speech data and the feature quantity of the second speech data is equal to or greater than a predetermined threshold value, the processing circuitry is configured to determine that the speaker of the first speech data is the same as the speaker of the second speech data.

6. The device according to claim 1, wherein the processing circuitry is further configured to input a text corresponding to the first speech data, and the processing circuitry is configured to consider speech data obtained by uttering of the received text as the first speech data, to determine whether or not the speaker of the first speech data is the same as the speaker of the second speech data.

7. A speech synthesis dictionary creating device comprising:

a processing circuitry coupled to a memory, the processing circuitry being configured to:

receive input of first speech data;

receive input of second speech data;

detect authentication information included in the second speech data;

output third speech data in which the authentication information is detected; and create a speech synthesis dictionary using the first speech data and using a text corresponding to the first speech data upon determining that a speaker of the first speech data is the same as a speaker of the third speech data.

8. The device according to claim 7, wherein the authentication information represents speech watermarking or speech waveform encryption.

9. A speech synthesis dictionary creating method comprising:

receiving input of first speech data;

selecting at least one text from texts stored in a memory;

present the selected text for a user to recognize and utter the selected text;

receiving input of second speech data which is considered to be speech data obtained by uttering of the presented text; and creating a speech synthesis dictionary using the first speech data and using a text corresponding to the first speech data upon determining that a speaker of the first speech data is the same as a speaker of the second speech data.

* * * * *